United States Patent [19]

Wilson

[11] Patent Number: 4,619,114

[45] Date of Patent: Oct. 28, 1986

[54] AUXILIARY OUTSIDE AIR REFRIGERATING MECHANISM

[76] Inventor: Ralph Wilson, 10739 Chicago Dr., Zeeland, Mich. 49464

[21] Appl. No.: 787,625

[22] Filed: Oct. 15, 1985

[51] Int. Cl.[4] ..... F25B 25/00

[52] U.S. Cl. ..... 62/180; 62/332; 165/104.34

[58] Field of Search ..... 62/180, 179, 332, 409, 62/412, 151, 140, 285; 165/54, 104.33, 104.34, 40

[56] References Cited

U.S. PATENT DOCUMENTS

| | | | |
|---|---|---|---|
| 60,760 | 1/1867 | Loomis | 165/54 |
| 99,254 | 1/1870 | Somes | 165/54 |
| 1,789,592 | 1/1931 | Moore | 165/54 |
| 1,813,188 | 7/1931 | Moore | 165/54 |
| 1,825,498 | 9/1931 | Wogan | 165/54 X |
| 2,764,391 | 9/1956 | Pullen | 165/122 |
| 2,882,023 | 4/1959 | Rizzo | 165/39 |
| 3,481,047 | 12/1969 | Engelhand | 165/70 |
| 3,677,338 | 7/1972 | Staub | 165/122 |
| 3,926,250 | 12/1975 | Engwall | 165/122 |
| 3,934,798 | 1/1976 | Goldsmith | 165/DIG. 2 |
| 4,106,474 | 8/1978 | Hunter et al. | 165/DIG. 2 |
| 4,147,038 | 4/1979 | Hoebing et al. | 62/180 |
| 4,147,206 | 4/1979 | Basiulis | 165/32 |
| 4,175,401 | 11/1979 | McManus | 62/180 |
| 4,178,770 | 12/1979 | Fox | 62/332 |
| 4,244,422 | 1/1981 | Hällgren | 165/1 |
| 4,250,716 | 2/1981 | Huffman | 62/180 |
| 4,334,577 | 6/1982 | George | 165/54 |
| 4,336,748 | 6/1982 | Martin et al. | 98/33 A |
| 4,391,321 | 7/1983 | Thunberg | 165/54 |

*Primary Examiner*—Harry Tanner
*Attorney, Agent, or Firm*—John A. Waters

[57] ABSTRACT

An auxiliary outside air refrigeration mechanism for a refrigerated storage room comprises an air-to-air heat exchanger wherein the two air supplies are sealed from each other by a physical seal and by a positive pressure air differential between the air supplies. An inlet and outlet for one air supply is connected to receive and return storage room air and an inlet and outlet for the other air supply is connected to receive and circulate outside air. A control mechanism automatically renders the auxiliary refrigerating mechanism operational when the outside temperature is a predetermined temperature below the upper temperature limit in the storage room. The control mechanism actuates the auxiliary refrigerating mechanism at a temperature below the temperature at which the conventional mechanical refrigerating unit is actuated, thus supplementing the conventional refrigerating unit when the outside temperature is cold. The control mechanism automatically switches off the outside air circulation when condensate in the heat exchanger freezes, and the unit self defrosts and drains the water through an inclined opening. The heat exchanger employs a special tube bundle formed of thin-walled thermoplastic tubes heat welded in openings in thermoplastic traverse mounting plates at opposite ends of the tube bundle.

16 Claims, 6 Drawing Figures

AUXILIARY OUTSIDE AIR REFRIGERATING MECHANISM

BACKGROUND OF THE INVENTION

This invention relates to an auxiliary outside air refrigerating mechanism for a refrigerated storage room or the like and more particularly to an electronically controlled refrigeration system that employs cold outside air to automatically assist or supplant a conventional refrigeration unit under appropriate circumstances.

Refrigerated storage rooms such as walk-in coolers are in widespread use in restaurants and stores that sell refrigerated products. Such coolers typically are cooled solely by conventional refrigerating units operated by compressors. These refrigerating units typically are in operation 100% of the time during summer months and about two thirds of the time during winter months. The compressors used to operate these refrigerating units generally are electrically operated, and substantial electrical expenses are involved in their operation.

An object of the present invention is to provide an auxiliary refrigerating unit that employs cold outside air to assist or supplant a conventional refrigeration unit in winter months, thereby reducing energy consumption and energy costs.

Another object of the present invention is to provide an auxiliary outside air refrigerating system that chills the air in a refrigerated storage unit without creating any danger of contamination of the storage room air supply by pollutants that may be carried in the outside air.

SUMMARY OF THE INVENTION

In accordance with the present invention, an auxiliary outside air refrigerating mechanism for refrigerated storage rooms such as a cooler or the like comprises an air-to-air heat exchanger having two pairs of inlets and outlets for receiving and re-circulating air supplies from two separate sources and a heat exchange means for transferring heat between the two air supplies without admixing the two air supplies. A first inlet and outlet is connected to the air in the storage room, and a second inlet is connected to a source of outside air. A storage room air fan re-circulates storage room air through the heat exchanger and an outside air fan circulates outside air through the heat exchanger. A control mechanism automatically actuates the storage room air fan and outside air fan whenever both the cooler temperature rises to a first predetermined temperature indicative of an upper storage room limit and the outside air temperature is no greater than a second predetermined temperature below the upper cooler limit. The control mechanism de-actuates at least one of these fans whenever the storage room temperature drops to a third predetermined temperature indicative of any lower storage room limit. The first predetermined temperature setting is below any fourth predetermined temperature setting for actuating a conventional storage room refrigeration unit, such that the storage room refrigeration unit does not operate as long as the auxiliary outside air refrigerating mechanism is effectively cooling the air in the storage room.

Contamination of the storage room air with the outside air is prevented by a double sealing system. First, the two air supplies are sealed from each other in the heat exchanger. In addition, a positive air pressure differential is created between the storage room air supply and the outside air supply so that if there is a leak in the heat exchanger, the storage room air flows into the outside air instead of the opposite. This is accomplished by placing the storage room air fan upstream of the heat exchanger and placing the outside air fan downstream of the heat exchanger.

The heat exchanger is slanted and includes a drain opening at a lower end so that water condensing in the heat exchanger will flow to the drain outlet and be evacuated from the system.

The control mechanism can be adapted to automatically slow the rate of cooling of the storage room air as the outside air temperature drops in order to minimize icing and provide a uniform rate of air cooling. The control mechanism gradually can slow the outside air fan as temperature drops or stop the fan at a set low temperature.

The present invention also includes an automatic de-icing mechanism, wherein an air flow sensor responsive to the rate of storage room air flow through the heat exchanger automatically shuts off the supply of outside air whenever the rate of air flow through the heat exchanger drops to a level indicative of condensate icing within the heat exchanger. The warmer storage room air will then be able to melt the ice and restore normal air flow before the outside air fan is again actuated.

An important feature of the present invention is the construction of the heat exchanger itself. While normal heat exchangers are formed of metal fins or tubes, the present invention employs an inexpensive and highly efficient tube bundle formed of thin-walled thermoplastic tubes heat welded to moldable plastic mounting plate means at the ends of the tubes. The tubes are formed of an extrudable plastic resin that can be formed in thin-walled tubes that do not become brittle at low temperatures. Polypropylene is preferred, but polytetrafluoroethylene will work. PVC can be employed although it can become brittle in thin-walled tubes at low temperatures. The tubes preferably are one-half inch thin polypropylene tubes having a 4 mil wall thickness. The tubes desirably are heat welded by means of a hot wire to mounting plates in the form of tube sheets positioned at opposite ends of the tubes. The tube sheets are formed of ABS plastic or polytetrafluoroethylene or like rigid plastic that similarly does not become brittle at low temperatures. A material that can be vacuum formed and hot wire welded to the tube is most desirable. A tube bundle formed in this manner is quite inexpensive and easy to fabricate and yet acts as an efficient heat exchanger.

These and other features and advantages of the present invention will become apparent from a description of the preferred embodiment of the present invention set forth below and shown in the appended drawings.

DETAILED DESCRIPTION OF THE PREFERRED EMBODIMENT

Figure 1:
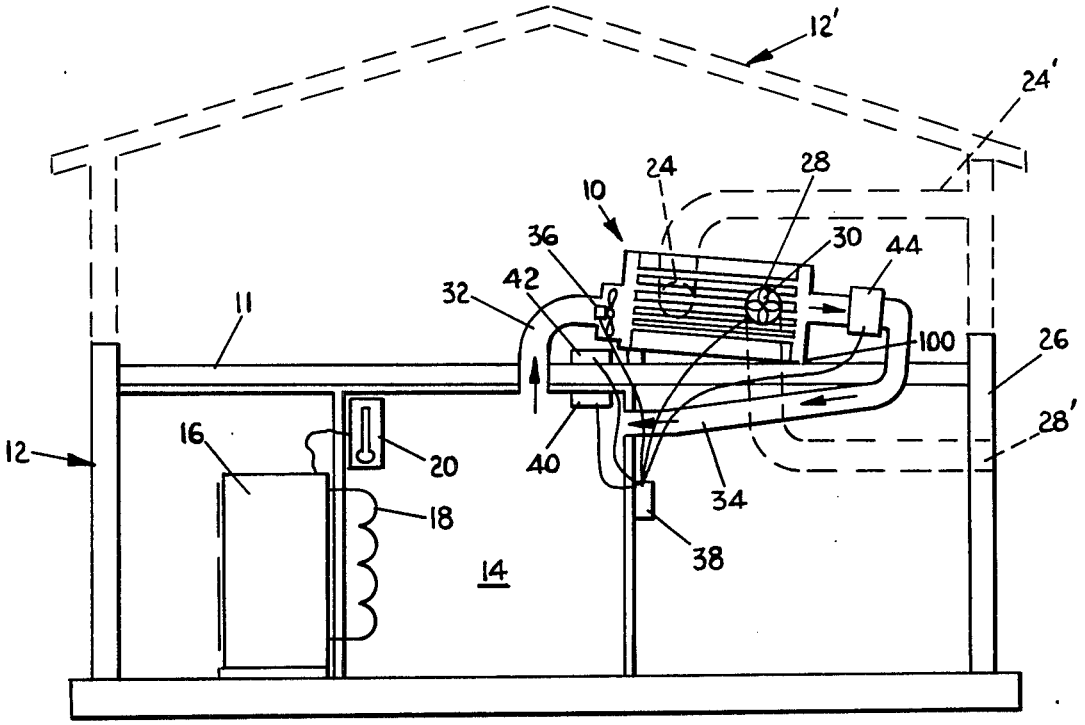
FIG. 1 is a schematic, pictorial view showing a refrigerated storage room employing the auxiliary outside air refrigerating unit of the present invention.

Referring to the drawings, an auxiliary outside air refrigerating mechanism 10 is shown in FIG. 1 in schematic form mounted on the roof 11 of a building 12 and connected to a conventional refrigerated storage room 14, which is cooled by a conventional electric compressor refrigerating unit 16 having refrigeration coils 18 and a thermostatic control unit 20. While the unit generally is mounted outside a building on a roof, it would be possible to mount the refrigeration mechanism inside a building, in the manner shown in phantom in FIG. 1 as building 12'.

With the mechanism mounted outside the building, outside air is admitted to a heat exchanger unit 22 through an inlet 24. The outside air passes through the heat exchanger and is exhausted through outlet 28. Outlet 28 can be directed outside the building, as shown, or could be to any other desired outlet area. Circulation of outside air is caused by a fan 30 positioned on the downstream side of the heat exchanger with regard to the direction of air flow through the heat exchanger.

If the heat exchanger is mounted inside the building, as shown in phantom in FIG. 1, inlet and outlet are connected by conduits 24' and 28' to the outside through openings in wall 26 of the building. Such an installation would not be typical, because the extra cooling produced by having the heat exchanger outside is generally desirable, unless the outside air is generally too cold.

Storage room air is admitted to the heat exchanger through a storage room air supply inlet 32 and is returned to the storage room via a storage room air outlet 34. Storage room air is re-circulated through the heat exchanger by means of a storage room air fan 36 positioned upstream of the heat exchanger with regard to the direction of storage room air flow through the heat exchanger. The heat exchanger is designed so that outside air is not admixed with storage room air as the respective air supplies flow through the heat exchanger.

The operation of the heat exchanger is controlled automatically. For illustration, the control means is shown schematically as an electronic control mechanism 38 in FIG. 1. This mechanism receives input information from a storage room temperature sensor 40, an outside air temperature sensor 42, and a storage room air flow sensor 44. In response to this information, the electronic control mechanism controls the actuation and de-actuation of the auxiliary refrigerating unit and the operation of fans 36 and 30. The control mechanism can comprise, instead of a separate control unit 38, thermostatic switches that control the actuation of the various electrical elements. The themostats are then incorporated into the temperature sensor units, with each thermostat being independently adjustable.

The operation of the auxiliary outside air refrigerating unit is controlled as follows: In normal operation of the storage room refrigerating unit, refrigerating unit 16 may be set to become actuated whenever temperature sensor or thermostat 20 reaches a predetermined warm temperature, for example 40° F. The refrigeration unit will then remain actuated until the temperature in the cooler is lowered to a lower temperature of about 36° F. These temperatures of course can be varied depending upon the temperature desired in the cooler. The control mechanism 38 (or thermostat 42) is designed to render the auxiliary refrigerating unit operational only when the outside air temperature is sufficiently low that the auxiliary cooling can have a beneficial effect in assisting the cooling in the storage room. This themostat (or another outside thermostat) can be set to prevent operation of the outside air refrigeratgor unit if it is too cold out, e.g., 40° F. below zero. Extremely low temperature operation can be undesirable. In the present example, the control unit is set to operate the auxilian refrigerating unit when the outside air temperature is no greater than about 38° Fahrenheit. The control unit (cooler thermostat 40) is set to actuate the auxiliary refrigerating unit when the temperature in the refrigerated storage room rises to a predetermined upper limit that is lower than the actuation temperature for the conventional refrigerating unit 16. This upper limit desirably is about be 39° F. when the conventional unit is set for 40° F. In this manner, the auxiliary refrigerating unit is actuated before the conventional refrigerating unit, and the conventional refrigerating unit will not be actuated as long as the auxiliary refrigerating unit is capable of maintaining the storage room temperature below the 40° F. actuation temperature of the conventional storage unit.

The control unit, when actuated, circulates the air from the cooler through the heat exchanger and then back into the cooler, while at the same time circulating the outside air over the heat exchanger.

In operation, when the outside temperature falls below the upper pre-set temperature of the outside temperature sensor (38° F.), the auxiliary refrigerator unit becomes operational or energized. Then when the storage room temperature sensor indicates a temperature rise to the pre-set point (39°), control 38 starts the operation of both the storage room and outside air fans. This initiation temperature can be referred to as the upper storage room limit or the first predetermined temperature.

In one aspect of the invention the control unit is designed to control the rate of cooling of the air in the storage room. Thus, as the outside temperature drops, the control unit slows the operation of the outside air fan. This assists in minimizing icing conditions in the heat exchanger as water condenses.

In another aspect of the invention, instead of using a variable fan speed and changing cooling, rates, a simple means is to to simply have the outside fan turn off when the outside air temperature drops to a predertimined low level. This is used when the heat exchanger is mounted outside, as is typically the case. When the temperature in the supply room drops to the lower desired limit or third predetermined temperature, the control unit de-actuates the auxiliary refrigerating unit fans.

When a thermostat having two shut off switches is used, it can be set to turn off the outside air fan at a higher temperature than the storage room air fan. When the air flow indicator 44 senses a decrease in the rate of storage room air flow through the heat exchanger that is indicative of condensate icing in the heat exchanger, the control unit (or a switch actuated by the flow indicator) shuts off the outside air fan 30 but maintains the operation of the storage room air fan 36. This permits the warm storage room air to defrost the heat exchanger and melt the ice in the heat exchanger until the normal rate of air flow is resumed, at which time the outside air fan can be re-actuated.

With this mechanism, actuation and operation of the auxiliary refrigerating unit can be automatic and the refrigerating unit will take care of its own icing problems and will limit its own operation to times when the auxiliary refrigerating unit can be efficiently used.

Figure 3:
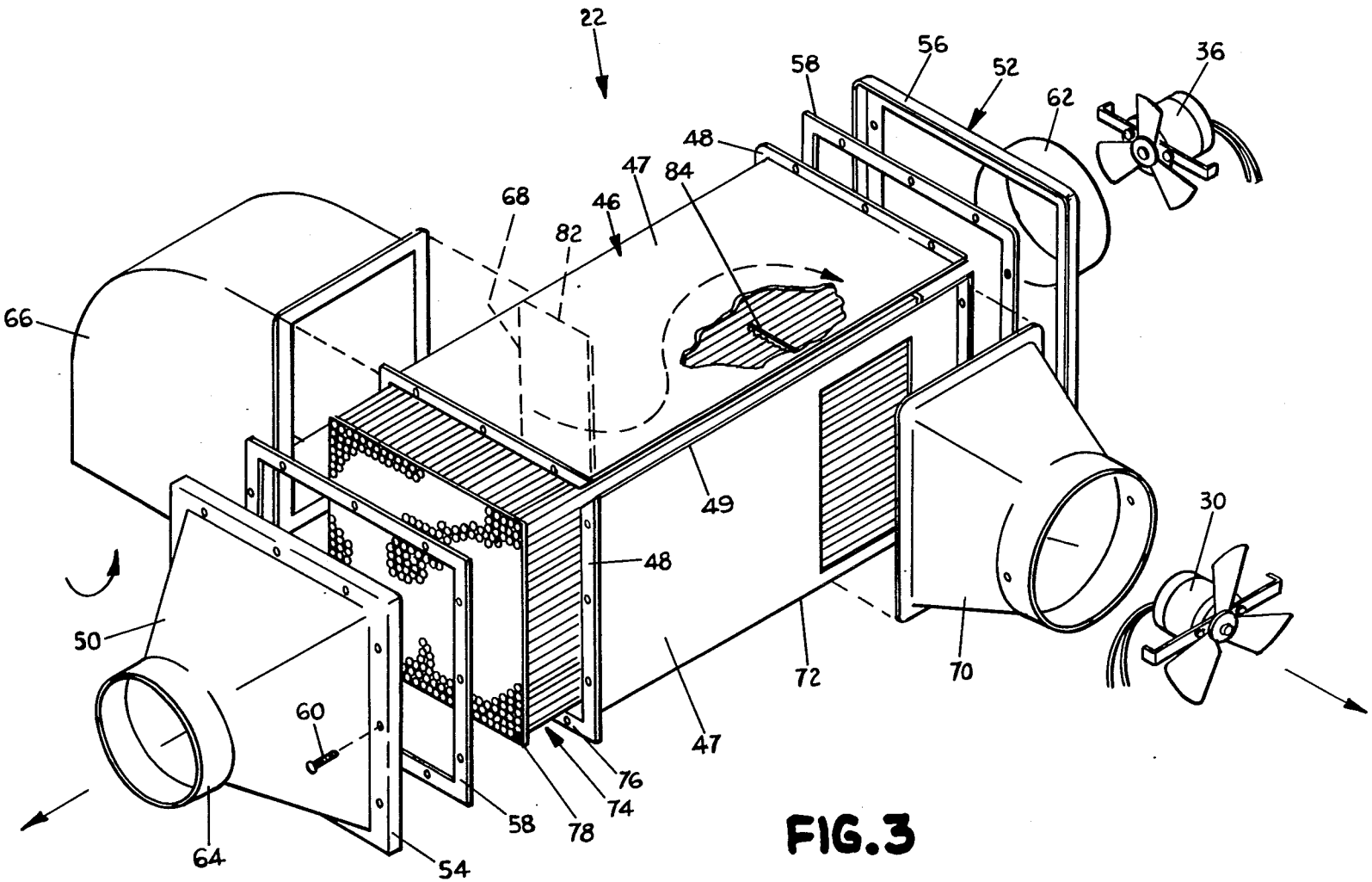
FIG. 3 is an exploded perspective view showing the heat exchanger unit of the present invention.
Figure 4:
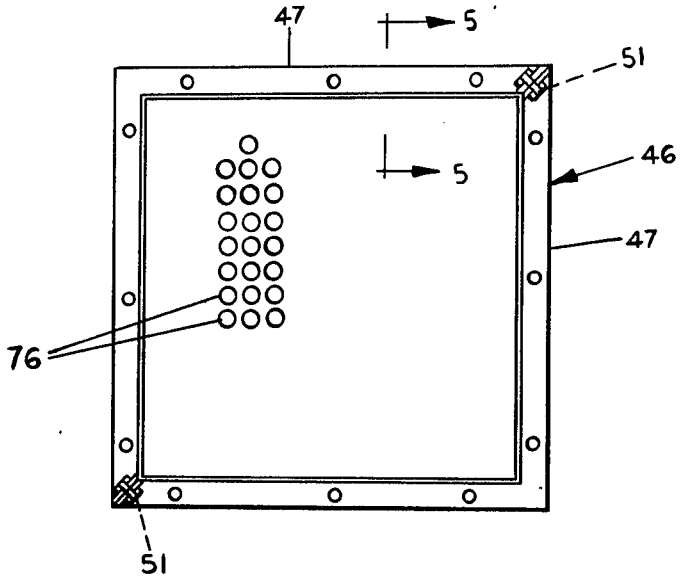
FIG. 4 is an end view of the heat exchange with the end cover removed.
Figure 5:
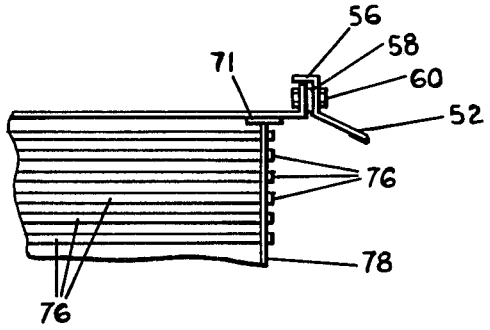
FIG. 5 is a sectional view taken along line 5—5 of FIG. 4.
Figure 6:
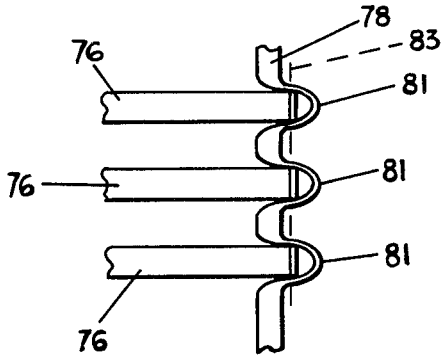
FIG. 6 is an enlarged edge view of a section of the tube sheet and heat exchanger tubes of the present invention.

A more detailed illustration of the heat exchanger unit is shown in FIG. 3. The heat exchanger unit 22 comprises an elongated hollow housing 46 formed in two right angle sections 47 joined by angular flanges 49 at adjoining edges by bolts 51 or like fasteners. The housing thus joined forms a tubular sleeve having outwardly extending flanges 48 at the ends thereof. The cross-sectional configuration of the housing is square or rectangular. Housing 46 has open ends, and cap enclosures 50 and 52 sealingly fit on the ends of the enclosure by means of outwardly extending right angle flanges 54 and 56 on the end caps (see FIG. 5). Gaskets 58, which can be foam plastic, fit between the end cap flanges and the flanges on the housing and seal the periphery of the housing. The end caps are fastened to the housing by means of conventional threaded fasteners 60. End cap 52 includes a round inlet 62 for the storage room air, and end cap 50 incorporates an outlet 64 for storage room air. The storage room air thus circulates lengthwise through the housing from inlet 62 to outlet 64 by means of fan 36, which is positioned at the upstream end of the housing adjacent the inlet.

Inlet 24 comprises an outside air intake duct 66 connected to an opening 68 in the side of the housing. Outlet 28 comprises an outside air exhaust duct 70 connected to an opening 72 in the opposite side of the housing. The intake or inlet duct is positioned at the opposite end of the housing from the exhaust or outlet duct, thus requiring that outside air flow not only across the housing but longitudinally along the length of the housing before it is exhausted. This maximizes the amount of time that the outside air is in the housing for heat exchange purposes before it is exhausted. Outside air is circulated through the housing by means of fan 30, which is positioned downstream or at the outlet end of the housing.

The heat exchange apparatus for the heat exchanger is provided by a tube bundle 74, which consists of a plurality of elongated, parallel, and closely spaced tubes 76 that extend longitudinally through the heat exchanger housing. These tubes are mounted at their ends in transverse mounting plates or tube sheets 78 at each end of the tubes. The open interior portions of the tubes extend through the mounting plates so that the tube outlets are on the outside of the mounting plates facing the inlet and outlet openings of the storage room air supply.

The mounting plates are sealingly mounted in the heat exchanger housing such that the interior portions of the tubes and the inlets and outlets for the storage room air supplies are isolated and sealed from the outside air that passes through the interior of the housing over the outer sides of the tubes. Such sealing is accomplished by fitting the tube bundle inside the housing before halves 42 are fastened together. The tube bundle is a little shorter than the housing so that the tube sheets are spaced inwardly in the housing by about ¼ inch (see FIG. 5). A comprehensible seal 71, such as a one inch wide by ¼ inch thick strip of foam plastic, is glued around the outer periphery of the housing at the ends. These strips engage and seal the outer edges of the tube sheets when the halves of the housing are clamped together, thus sealing the exterior from the interior portions of the housing on opposite sides of the tube sheets.

The construction of the tube bundle 74 is an important feature of the present invention. Tube bundle 74 is formed of a plurality of thin-walled tubes formed of a moldable plastic, preferably polypropylene. Teflon (polytetrafluoroethelene) or polyvinylchloride (PVC) also will work, as long as the tubes remain ductile or non-brittle at low temperatures that might be expected. In some applications the low temperature could be 40° F. below zero. Desirably these tubes have a wall thickness of about 4 mils and are about one-half inch in outside diameter. The tubes are thermally welded by means of a hot wire or the like to the tube sheets, which also desirably are formed of a moldable plastic. The plastic desirably is an ABS plastic but also could be polytetrafluoroethylene. The tubes are formed by vacuum forming dimples 81 in the sheet, fitting the ends of the tube in the dimples, and cutting off the ends of the tubes and dimples with a hot wire 83. This fuses the tubes in the sheet, leaving the tubes extending about one-eighth inch from the sheet.

Baffles 82 and 84 extend inwardly into the housing at the edges of the outside air inlets and outlets respectively so as to force the outside air to traverse an S-shaped path in passing through the housing. This maximizes the contact between the outside air and the tubes of the tube bundle in order to maximize the amount of heat exchange that occurs within the heat exchanger itself.

A tube bundle constructed in this manner, with a high number of narrow, thin-walled tubes being very closely spaced, provides an efficient and yet inexpensive heat exhanger mechanism in the present invention. It would not be feasible to provide such a heat exchanger by means of conventional metal tubing, within any reasonable cost limitation.

Figure 2:
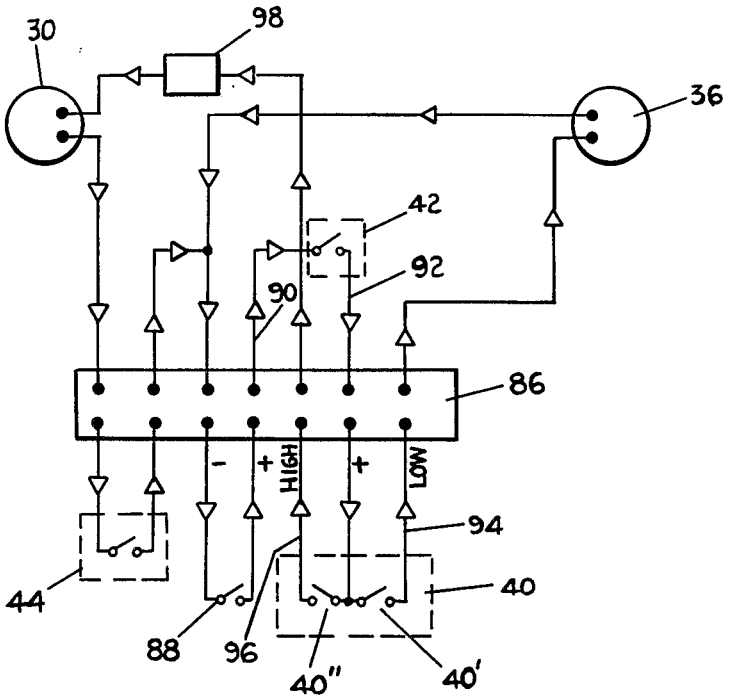
FIG. 2 is an electrical schematic diagram of the control circuit of the present invention.

A circuit diagram of the control mechanism of the present invention is shown in FIG. 2. The various fans and controls are interconnected by means of a bus 86. Tracing the circuit, fans 30 and 36 are interconnected by leads to a master disconnect switch 88. The disconnect switch is connected to outside air temperature sensor 42 by means of a conductor 90. Outside air sensor 42, as shown, is a thermostat that prevents the auxiliary refrigerating unit from operating unless the outside air temperature is sufficiently low to insure that meaningful cooling will be accomplished by the air. Outside air thermostat 42 is connected by lead 92 through the bus to cooler temperature sensor 40. This preferably is a single pole single throw thermostat but could also be a double pole double throw thermostat. The thermostat actuates both fans 30 and 36 whenever the cooler temperature rises to a predetermined temperature (e.g., 39° F.). The thermostat can be adjusted so that the cut-off point for the two fans differs. For example, when the cooler temperature drops to a predetermined lower limit, the thermostat can cut off the outside air flow yet permit the storage room air fan to continue to re-circulate storage room air through the heat exchanger until a lower temperature is reached. With the single pole single throw thermostat, the tolerances on the cut off sequence are closer than with the double pole double throw thermostat. To do this, the storage room temperature sensor or thermostat is connected to storage room air fan 36 by means of a conduit 94 leading from the low pole 40' of the thermostatic switch. A conduit 96 leads to outside air fan 30 from the high side 40" of the thermostatic switch. A separate variable control 98 can regulate the rate of operation of the outside air fan in accordance with the actual temperature of the outside air. This control includes a variable control that gradually decreases the rate of operation of fan 30 in accordance with a gradual decrease in outside temperature.

As shown in FIG. 1, when the unit is mounted in operation, the housing is placed in an inclined position with a drain hole 100 being positioned at the lowest point of the storage room air outlet end cap in the heat exchanger. Thus, when water condenses from the storage room air as it is cooled in the tube bundle, the water flows downwardly through the tubes into the end cap and then outwardly through drain 100 and out of the heat exchanger. The flow of air in the direction of water drainage facilitates the movement of the water out of the tube bundles.

The principal advantage of the present invention is that it provides a substantially lower use of electrical energy during winter months. While a typical conventional refrigerating unit for a walk-in cooler might employ a 1½ to 2 h.p. motor for a newer unit or a 4 h.p. motor for an older unit and these might involve energy use at the rate of 2.0–5.5 kilowatts, the fans of the present invention, which are the only electrical components, are only about 1/15 of a h.p. apiece, thus drawing about 0.28 kilowatts, for a saving of 1.75–5.2 kilowatts when the auxiliary refrigerating unit is operating. Translated into dollars and cents, this can realize an appreciable savings in the operation of a refrigerated storage room.

It should be understood that the foregoing represents merely a preferred embodiment of the present invention and that various modifications and changes may be made in the details of construction and operation of the present invention without departing from the spirit and scope of the present invention, as defined in the appended claims.

I claim:

1. An auxiliary outside air refrigerating means for a refrigerated storage room such as a cooler or the like comprising:

a heat exchanger having two pairs of inlets and outlets for receiving and re-circulating air supplies from two separate sources and a heat exchange means for transferring heat between the two air supplies without admixing the two air supplies, a first inlet and outlet being connected to the air in the storage room, a second inlet being connected to a source of outside air;

a storage room air fan for re-circulating storage room air through the heat exchanger;

an outside air fan for circulating outside air through the heat exchanger; and control means for automatically actuating the storage room air fan and outside air fan whenever both the cooler temperature rises to a first predetermined temperature indicative of an upper storage room limit and the outside air temperature is no greater than a second predetermined temperature below the upper storage room limit, the control means de-actuating at least one of the fans whenever the storage room temperature drops to a third predetermined temperature indicative of any lower storage room limit, the first predetermined temperature setting being below any fourth predetermined temperature setting for actuating a conventional storage room refrigeration unit, such that the storage room refrigeration unit does not operate as long as the auxiliary outside air refrigeration means is effectively cooling the air in the storage room.

2. An auxiliary outside air refrigerating means according to claim 1 wherein the air fans are positioned and operated such that there is a positive air pressure differential between the storage room air supply and the outside air supply in the heat exchanger, with the relative pressure of the storage room air supply being higher than the outside air supply so as to prevent infiltration of outside air into the storage room air supply in the event of a leak in the heat exchanger.

3. An auxiliary outside air refrigerating means according to claim 2 wherein a positive air pressure differential is achieved by placement of the outside air fan downstream of the heat exchange means and placement of the storage room air fan upstream of the heat exchange means.

4. An auxiliary outside air refrigerating means according to claim 1 wherein the control means include air flow regulation means for varying the rate of air flow through the heat exchanger in accordance with the outside temperature so as to slow the rate of heat exchange as the outside temperature gets colder.

5. An auxiliary outside air refrigerating means according to claim 4 wherein the air flow regulation means at least slows the outside air fan in accordance with a drop in the outside air temperature drops so as to reduce the rate of chilling of the storage room air in the heat exchanger.

6. An auxiliary outside air refrigerating means according to claim 1 wherein the air from the storage room flows through a heat exchange chamber in the heat exchanger and is cooled therein, the heat exchange chamber being formed and positioned such that water condensing in the heat exchange chamber flows under gravity toward at least one drain outlet in the heat exchanger, the water flowing out of the heat exchanger through the drain outlet.

7. An auxiliary outside air refrigerating means according to claim 1 wherein the control means include sensor means for detecting the rate of storage room air flow through the heat exchanger, the control means shutting off the outside air fan and thereby stopping circulation of outside air through the heat exchanger whenever the sensor detects a predetermined drop in air flow that is indicative of condensate icing in the heat exchanger, the storage room air fan continuing to operate without operation of the outside air fan until the relatively warmer storage room air melts the frozen condensate and restores normal air flow through the heat exchanger.

8. An auxiliary outside air refrigerating means according to claim 1 wherein the control means automatically actuates a conventional refrigerating unit in the event that the storage room air temperature rises to the fourth predetermined temperature above the storage room upper limit so as to supplement the chilling of the storage room air in the event that the auxiliary refrigerating means is not alone sufficient for the required cooling.

9. An auxiliary outside air refrigerating means according to claim 1 wherein the heat exchange means comprises a bundle of parallel hollow tubes mounted in a hollow housing, the parallel tubes having inlets and outlets in isolated communication with the respective inlets and outlets of one air supply, said tube inlets and outlets being sealed off from communication with the outer sides of the tubes, the inlet and outlet for the other air supply being in the housing such that air from said other air supply flows through the housing and over the outer sides of the tubes in flowing through the heat exchanger, thus effecting heat exchange between the two air supplies.

10. An auxiliary outside air refrigerating means according to claim 9 wherein the tubes are closely spaced moldable plastic tubes that are heat welded adjacent their ends to moldable plastic mounting plate means for supporting the tubes, with the openings in the tubes extending through the mounting plate means, the mounting plate means being positioned in the housing so as to position the tube inlets and outlets in communication with the inlet and outlet from one air supply while separating the inlet and outlet of the one air supply from communication with the inlet and outlet of the other air supply.

11. An auxiliary outside air refrigerating means according to claim 10 wherein the housing is an elongated tubular sleeve and the inlet and outlet for the storage room air supply are formed in caps that sealingly fit over opposite ends of the sleeve, the tubes being elongated parallel tubes that extend through the sleeve, the outside air inlet and outlet being formed in the sleeve between the ends thereof, the mounting plate means being separate transverse mounting plates positioned at opposite ends of the tubes, the mounting plates being sealingly mounted at opposite ends of the sleeve so as to seal the interior of the sleeve and the outside air supply from the interiors of the tube and the storage room inlet and outlet.

12. An auxiliary outside air refrigerating means according to claim 11 wherein the tube bundle is formed of polypropylene tubes having a wall thickness of about 4 mils, with the mounting plates being ABS plastic or polytetrafluoroethylene tube sheets and the tubes being hot wire welded to the tube sheets.

13. An auxiliary outside air refrigerating means according to claim 1 wherein the heat exchange means commprises a hollow elongated housing having inlet and outlet openings for one air supply in the sides of the housing and inlet and outlet openings for another air supply in the ends of the housing, and a tube bundle mounted in the interior of the housing, the tube bundle comprising a plurality of spaced, parallel elongated tubes mounted in transverse mounting plates at each end of the tube bundle, the mounting plates having openings therethrough that communicate with open interiors of the tubes, the tubes and mounting plates being formed of a thermoplastic resin and being attached together such that the mounting plate is sealingly attached to the outer peripheries of the tubes, the tube bundle fitting in the elongated housing with the outer periphery of the mounting plates abutting and sealingly engaging the opposite ends of the housing, such that the interior of the housing between the mounting plates and outside the tubes is in communication with the inlet and outlet in the side of the housing but is sealed from the inlet and outlet in the ends of the housing, the open interior passages through the tubes conversely being in communication with the inlet and outlet in the ends of the housing but being sealed from the inlet and outlet in the side of the housing.

14. An auxiliary outside air refrigeration means according to claim 13 wherein the tubes of the tube bundle are formed of polypropylene and are thermoplastically welded in mounting plates formed of ABS or polytetrafluoroethylene, the tube bundles being formed of a large number of relatively thin, closely spaced tubes providing long, narrow and convoluted transverse air passages over the outer sides of the tubes so as to maximize the heat exchange capabilities of the tube bundle.

15. An auxiliary outside air refrigeration means according to claim 14 wherein the tube sheets are polypropylene.

16. An auxiliary outside air refrigeration means according to claim 13 wherein the housing is formed in two right angle sections, with each section including two adjacent sides of the housing, the sections being joined together along their adjacent edges, the tube bundle fitting inside the housing with the mounting plates adjacent the ends of the housing, the outer edges of the mounting plates abutting the sides of the housing with a compressible seal therebetween so as to seal the outside air and storage room air supplies from each other inside the heat exchanger.

* * * * *